US010559920B1

(12) United States Patent
Champion et al.

(10) Patent No.: US 10,559,920 B1
(45) Date of Patent: Feb. 11, 2020

(54) CARD EDGE CONNECTOR HAVING IMPROVED MATING INTERFACE

(71) Applicant: TE CONNECTIVITY CORPORATION, Berwyn, PA (US)

(72) Inventors: Bruce Allen Champion, Camp Hill, PA (US); Eric David Briant, Dillsburg, PA (US)

(73) Assignee: TE CONNECTIVITY CORPORATION, Berwyn, PA (US)

( * ) Notice: Subject to any disclaimer, the term of this patent is extended or adjusted under 35 U.S.C. 154(b) by 0 days.

(21) Appl. No.: 16/056,698

(22) Filed: Aug. 7, 2018

(51) Int. Cl.
*H01R 13/631* (2006.01)
*H01R 12/73* (2011.01)
*H01R 12/72* (2011.01)

(52) U.S. Cl.
CPC ..... *H01R 13/631* (2013.01); *H01R 12/721* (2013.01); *H01R 12/73* (2013.01)

(58) Field of Classification Search
CPC ..... H01R 12/721; H01R 12/73; H01R 12/85; H01R 12/88; H01R 13/193; H01R 13/631
USPC ..... 439/73, 377
See application file for complete search history.

(56) References Cited

U.S. PATENT DOCUMENTS 4,734,060 A 3/1988 Kawawada et al.
5,750,973 A 5/1998 Kaufman et al.
5,785,534 A 7/1998 Longueville et al.
5,823,823 A 10/1998 Longueville et al.
9,257,778 B2 2/2016 Buck et al.
9,742,088 B1 8/2017 Pickel et al.
9,780,473 B2 10/2017 Sasaki
9,935,403 B1 * 4/2018 Briant ..... H05K 9/0058
10,050,369 B1 * 8/2018 Yang ..... H01R 13/405
10,104,760 B1 * 10/2018 Briant ..... G02B 6/4268
2002/0064988 A1 * 5/2002 Fujita ..... H01R 13/7034 439/260
2002/0070274 A1 6/2002 Lee
2004/0229491 A1 * 11/2004 Maeda ..... H01R 12/88 439/260
2008/0274654 A1 11/2008 Yasumura et al.
2014/0141650 A1 * 5/2014 Sellmer ..... H01R 12/721 439/620.2
2018/0006406 A1 1/2018 Craton
2018/0109020 A1 * 4/2018 Tatzel ..... H01R 12/89

* cited by examiner

*Primary Examiner* — Oscar C Jimenez

(57) ABSTRACT

A card edge connector includes a contact assembly received in a cavity of a housing having a card slot in a shroud configured to receive a card edge of a module circuit board of a pluggable module. The contact assembly has upper and lower contacts having mating ends. The card edge connector includes upper biasing members at a top wall of the shroud associated with corresponding upper contacts each having an outer biasing surface engaging the pluggable module when mated with the card edge connector and having an inner biasing surface engaging the contact assembly proximate to the corresponding upper contact. The upper biasing member is movable from a released position to a compressed position. The upper biasing member moves the upper contact from an unmated position to a mated position as the upper biasing member is moved from the released position to the compressed position.

20 Claims, 6 Drawing Sheets

CARD EDGE CONNECTOR HAVING IMPROVED MATING INTERFACE

BACKGROUND OF THE INVENTION

The subject matter herein relates generally to card edge connectors of communication systems.

Some communication systems utilize communication connectors, such as card edge connectors to interconnect various components of the system for data communication. Some known communication systems use pluggable modules, such as I/O modules, that are electrically connected to the card edge connectors. The pluggable modules have module circuit boards having card edges that are mated with the card edge connectors during the mating operation. Each card edge connector has an upper row of contacts and a lower row of contact for mating with the corresponding circuit card. The contacts are typically curved at the mating ends to provide a large lead-in for the circuit card during mating to prevent stubbing and damage to the contacts during mating. However, such extra lengths of contacts at the ends of the contacts beyond the mating interfaces of the contacts create electrical stubs that affect the electrical performance of the card edge connectors.

A need remains for a card edge connector having an improved mating interface greatly reducing electrical stubs of the contacts of the card edge connector.

BRIEF DESCRIPTION OF THE INVENTION

In one embodiment, a card edge connector for mating with a pluggable module is provided including a housing and a contact assembly received in a cavity of the housing. The housing extends between a front and a rear. The housing has a card slot configured to receive a card edge of a module circuit board of the pluggable module. The housing has a top wall above the card slot and a bottom wall below the card slot, A contact assembly is received in the cavity having contacts having mating ends along the card slot for mating with the module circuit board and terminating ends opposite the mating ends. Biasing members extend from the housing each having an outer biasing surface configured to engage the pluggable module when the pluggable module is mated with the card edge connector and an inner biasing surface configured to operably engage the contact assembly proximate to the corresponding contact. The biasing member is movable from a released position to a compressed position as the pluggable module is mated with the card edge connector. The biasing members move the contacts from unmated positions to mated positions as the biasing members are moved from the released positions to the compressed positions.

In another embodiment, a card edge connector for mating with a pluggable module is provided including a housing and a contact assembly received in a cavity of the housing. The housing extends between a front and a rear and has a shroud at the front having a card slot configured to receive a card edge of a module circuit board of the pluggable module. The shroud has a top wall above the card slot and a bottom wall below the card slot and is configured to be mounted to a host circuit board. The contact assembly has upper contacts arranged in an upper contact array and lower contacts arranged in a lower contact array. The upper contacts have mating ends extending into the shroud for mating with the circuit board and terminating ends configured to be terminated to the host circuit board. The lower contacts have mating ends extending into the shroud for mating with the circuit board and terminating ends configured to be terminated to the host circuit board. The card edge connector includes upper biasing members at the top wall of the shroud associated with corresponding upper contacts. Each upper biasing member has an outer biasing surface configured to engage the pluggable module when the pluggable module is mated with the card edge connector and each upper biasing member has an inner biasing surface configured to operably engage the contact assembly proximate to the corresponding upper contact. The upper biasing member is movable from a released position to a compressed position as the pluggable module is mated with the card edge connector. The upper biasing member moves the upper contact from an unmated position to a mated position as the upper biasing member is moved from the released position to the compressed position. The card edge connector includes lower biasing members at the top wall of the shroud associated with corresponding lower contacts. Each lower biasing member has an outer biasing surface configured to engage the pluggable module when the pluggable module is mated with the card edge connector and each lower biasing member has an inner biasing surface configured to operably engage the contact assembly proximate to the corresponding lower contact. The lower biasing member is movable from a released position to a compressed position as the pluggable module is mated with the card edge connector. The lower biasing member moves the lower contact from an unmated position to a mated position as the lower biasing member is moved from the released position to the compressed position.

In a further embodiment, a communication system is provided including a pluggable module and a card edge connector receiving the pluggable module. The pluggable module has a pluggable body having a mating end and a module circuit board at the mating end having a card edge. The pluggable body has a module upper wall at the mating end above the card edge and a module lower wall at the mating end below the card edge. The card edge connector includes a housing and a contact assembly received in a cavity of the housing. The housing extends between a front and a rear and has a shroud at the front having a card slot configured to receive a card edge of a module circuit board of the pluggable module. The shroud has a top wall above the card slot and a bottom wall below the card slot and is configured to be mounted to a host circuit board. The contact assembly has upper contacts arranged in an upper contact array and lower contacts arranged in a lower contact array. The upper contacts have mating ends extending into the shroud for mating with the circuit board and terminating ends configured to be terminated to the host circuit board. The lower contacts have mating ends extending into the shroud for mating with the circuit board and terminating ends configured to be terminated to the host circuit board. The card edge connector includes upper biasing members at the top wall of the shroud associated with corresponding upper contacts. Each upper biasing member has an outer biasing surface configured to engage the pluggable module when the pluggable module is mated with the card edge connector and each upper biasing member has an inner biasing surface configured to operably engage the contact assembly proximate to the corresponding upper contact. The upper biasing member is movable from a released position to a compressed position as the pluggable module is mated with the card edge connector. The upper biasing member moves the upper contact from an unmated position to a mated position as the upper biasing member is moved from the released position to the compressed position. The card edge connector includes lower biasing members at the top wall of the shroud associated with corresponding lower contacts. Each lower biasing member has an outer biasing surface configured to engage the pluggable module when the pluggable module is mated with the card edge connector and each lower biasing member has an inner biasing surface configured to operably engage the contact assembly proximate to the corresponding lower contact. The lower biasing member is movable from a released position to a compressed position as the pluggable module is mated with the card edge connector. The lower biasing member moves the lower contact from an unmated position to a mated position as the lower biasing member is moved from the released position to the compressed position.

DETAILED DESCRIPTION OF THE INVENTION

Figure 1:
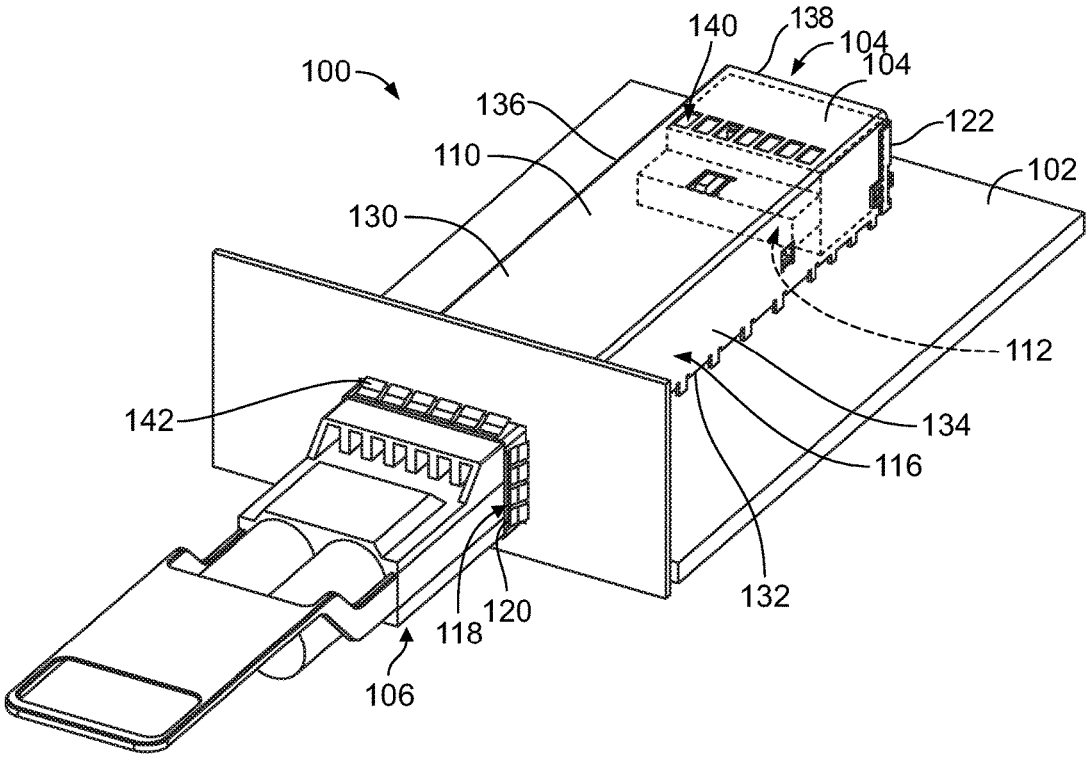
FIG. 1 is a front perspective view of a communication system formed in accordance with an exemplary embodiment.

FIG. 1 is a front perspective view of a communication system 100 formed in accordance with an exemplary embodiment. The communication system includes a host circuit board 102 and a receptacle connector assembly 104 mounted to the host circuit board 102. A pluggable module 106 (fully shown in FIG. 2) is configured to be electrically connected to the receptacle connector assembly 104. The pluggable module 106 is electrically connected to the host circuit board 102 through the receptacle connector assembly 104.

In an exemplary embodiment, the receptacle connector assembly 104 includes a receptacle cage 110 and a card edge connector 112 (shown with phantom lines) adjacent the receptacle cage 110. For example, in the illustrated embodiment, the card edge connector 112 is received in the receptacle cage 110. In other various embodiments, the card edge connector 112 may be located rearward of the receptacle cage 110. In various embodiments, the receptacle cage 110 is enclosed and provides electrical shielding for the card edge connector 112. The pluggable modules 106 are loaded into the receptacle cage 110 and are at least partially surrounded by the receptacle cage 110. In an exemplary embodiment, the receptacle cage 110 is a shielding, stamped and formed cage member that includes a plurality of shielding walls 114 that define one or more module channels for receipt of corresponding pluggable modules 106. In other embodiments, the receptacle cage 110 may be open between frame members to provide cooling airflow for the pluggable modules 106 with the frame members of the receptacle cage 110 defining guide tracks for guiding loading of the pluggable modules 106 into the receptacle cage 110. In other various embodiments, the receptacle connector assembly 104 may be provided without the receptacle cage 110, rather only including the card edge connector 112.

In the illustrated embodiment, the receptacle cage 110 is a single port receptacle cage configured to receive a single pluggable module 106. In other various embodiments, the receptacle cage 110 may be a ganged cage member having a plurality of ports ganged together in a single row and/or a stacked cage member having multiple ports stacked as an upper port and a lower port. The receptacle cage 110 includes a module channel 116 having a module port 118 open to the module channel 116. The module channel 116 receives the pluggable module 106 through the module port 118. In an exemplary embodiment, the receptacle cage 110 extends between a front end 120 and a rear end 122. The module port 118 is provided at the front end 120. Any number of module channels 116 may be provided in various embodiments arranged in a single column or in multiple columns (for example, 2×2, 3×2, 4×2, 4×3, 4×1, 2×1, and the like). Optionally, multiple card edge connectors 112 may be arranged within the receptacle cage 110, such as when multiple rows and/or columns of module channels 116 are provided.

In an exemplary embodiment, the walls 114 of the receptacle cage 110 include a top wall 130, a bottom wall 132, a first side wall 134 and a second side wall 136 extending from the top wall 130. The bottom wall 132 may rest on the host circuit board 102. In other various embodiments, the receptacle cage 110 may be provided without the bottom wall 132. Optionally, the walls 114 of the receptacle cage 110 may include a rear wall 138 at the rear end 122. The walls 114 define a cavity 140. For example, the cavity 140 may be defined by the top wall 130, the bottom wall 132, the side walls 134, 136 and the rear wall 138. The cavity 140 includes the module channel 116. In various embodiments, the cavity 140 receives the card edge connector 112, such as at the rear end 122. Other walls 114 may separate or divide the cavity 140 into additional module channels 116, such as in embodiments using ganged and/or stacked receptacle cages. For example, the walls 114 may include one or more vertical divider walls between ganged module channels 116. In various embodiments, the walls 114 may include a separator panel between stacked upper and lower module channels 116. The separator panel may include an upper panel and a lower panel that form a space between the upper and lower module channels 116, such as for airflow, for a heat sink, for routing light pipes, or for other purposes.

In an exemplary embodiment, the receptacle cage 110 may include one or more gaskets 142 at the front end 120 for providing electrical shielding for the module channels 116. For example, the gaskets 142 may be provided at the port 118 to electrically connect with the pluggable modules 106 received in the module channel 116. Optionally, the pluggable module 106 may include a gasket that engages the receptacle cage 110 rather than the receptacle cage 110 having a gasket that engages the pluggable module 106. In an exemplary embodiment, the gaskets 142 may be provided around the exterior of the receptacle cage 110 for interfacing with a panel (not shown), such as when the front end 120 of the receptacle cage 110 extends through a cutout in the panel. The gaskets 142 may include spring fingers or other deflectable features that are configured to be spring biased against the panel to create an electrical connection with the panel.

Optionally, the receptacle connector assembly 104 may include one or more heat sinks (not shown) for dissipating heat from the pluggable modules 106. For example, the heat sink may be coupled to the top wall 130 for engaging the pluggable module 106 received in the module channel 116. The heat sink may extend through an opening in the top wall 130 to directly engage the pluggable module 106. Other types of heat sinks may be provided in alternative embodiments.

In an exemplary embodiment, the card edge connector 112 is received in the cavity 140, such as proximate to the rear wall 138. However, in alternative embodiments, the card edge connector 112 may be located behind the rear wall 138 exterior of the receptacle cage 110 and extend into the cavity 140 to interface with the pluggable module(s) 106. In an exemplary embodiment, a single card edge connector 112 is provided. In alternative embodiments, the communication system 100 may include multiple card edge connectors 112 (for example, for stacked and/or ganged receptacle cages) for mating with corresponding pluggable modules 106.

In an exemplary embodiment, the pluggable modules 106 are loaded through the port 118 at the front end 120 to mate with the card edge connector 112. The shielding walls 114 of the receptacle cage 110 provide electrical shielding around the card edge connector 112 and the pluggable module 106, such as around the mating interface between the card edge connector 112 and the pluggable module 106.

Figure 2:
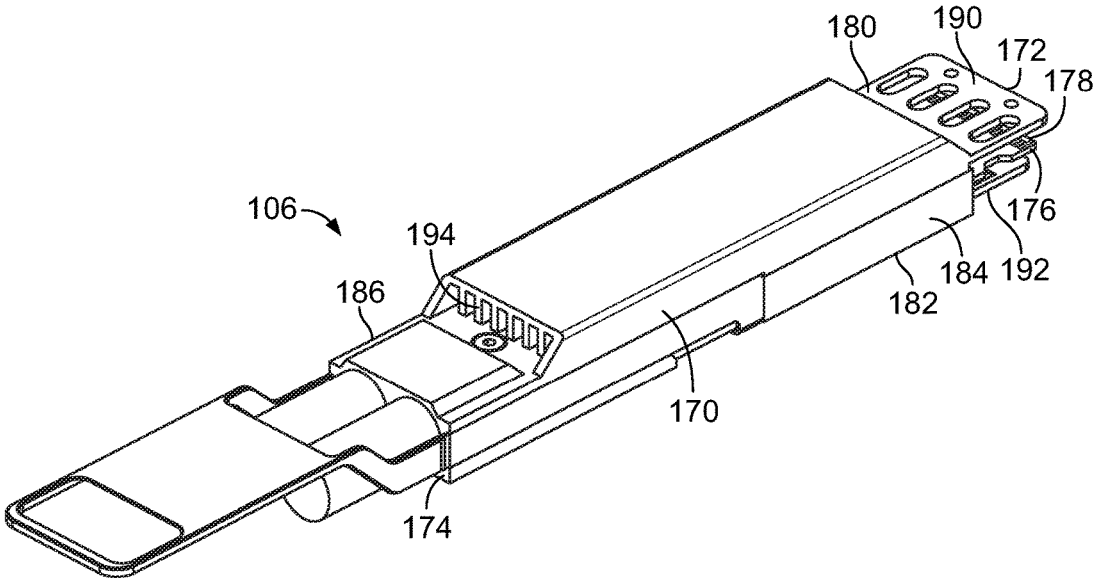
FIG. 2 is a front perspective view of a pluggable module of the communication system in accordance with an exemplary embodiment.
Figure 3:
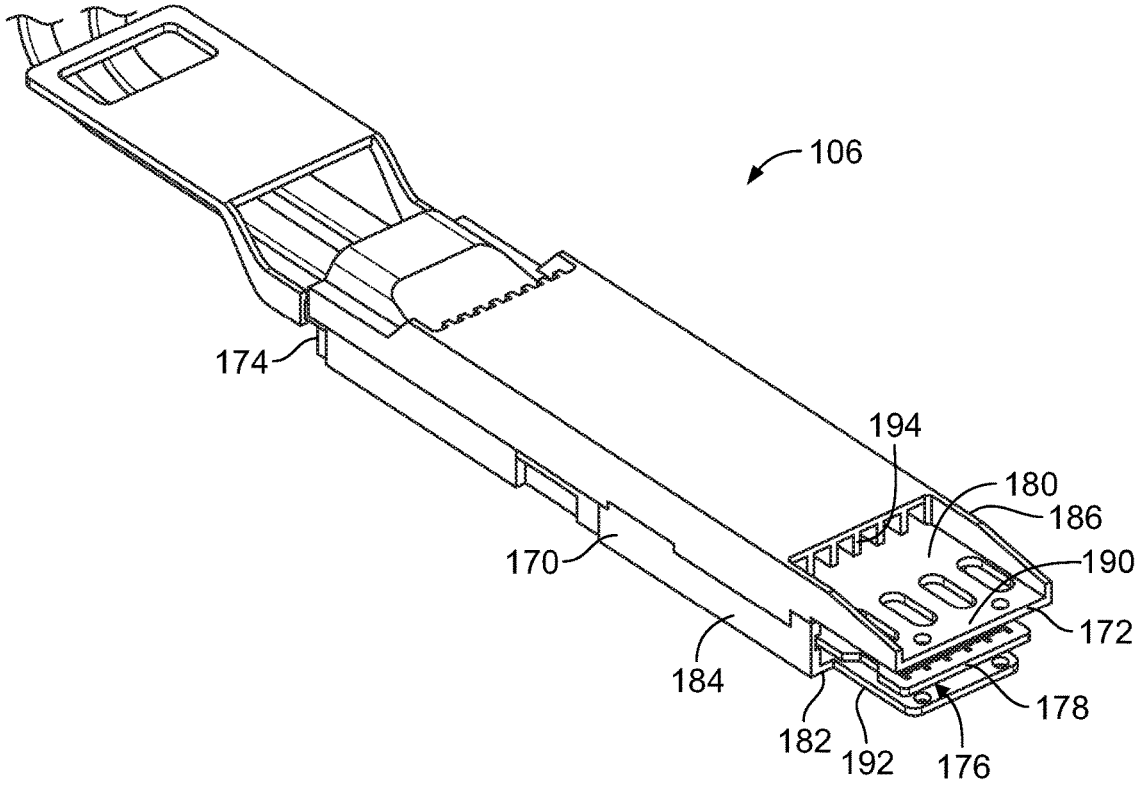
FIG. 3 is a rear perspective view of the pluggable module in accordance with an exemplary embodiment.

FIG. 2 is a front perspective view of the pluggable module 106 in accordance with an exemplary embodiment. FIG. 3 is a rear perspective view of the pluggable module 106 in accordance with an exemplary embodiment. The pluggable module 106 has a pluggable body 170, which may be defined by one or more shells. The pluggable body 170 may be thermally conductive and/or may be electrically conductive, such as to provide EMI shielding for the pluggable module 106. The pluggable body 170 includes a mating end 172 and an opposite front end 174. The mating end 172 is configured to be inserted into the corresponding module channel 116 (shown in FIG. 1). The front end 174 may be a cable end having a cable extending therefrom to another component within the system.

The pluggable module 106 includes a module circuit board 176 that is configured to be communicatively coupled to the card edge connector 112 (shown in FIG. 1). The module circuit board 176 may be accessible at the mating end 172. The module circuit board 176 has a card edge 178 and mating contacts at the card edge 178 configured to be mated with the card edge connector 112. The module circuit board 176 may include components, circuits and the like used for operating and or using the pluggable module 106. For example, the module circuit board 176 may have conductors, traces, pads, electronics, sensors, controllers, switches, inputs, outputs, and the like associated with the module circuit board 176, which may be mounted to the module circuit board 176, to form various circuits.

The pluggable module 106 includes an outer perimeter defining an exterior of the pluggable body 170. For example, the outer perimeter may be defined by a top 180, a bottom 182, a first side 184 and a second side 186. The pluggable body 170 may have other shapes in alternative embodiments. In an exemplary embodiment, the pluggable module 106 includes a module top wall 190 at the mating end 172 above the module circuit board 176 and a module bottom wall 192 at the mating end 172 below the module circuit board 176. The module top wall 190 and the module bottom wall 192 shroud the module circuit board 176 and protect the module circuit board 176 during mating. In an exemplary embodiment, the module top wall 190 and the module bottom wall 192 are used to actuate the contacts of the card edge connector 112 into mating engagement with the module circuit board 176 as the pluggable module 106 is mated with the card edge connector 112, as described in further detail below. As such, the mating action of the pluggable module 106 with the card edge connector 112 is used to activate the mating action and electrical connection between the card edge connector 112 and the module circuit board 176. The contacts of the card edge connector 112 may be held open in released positions and clamped closed on to the module circuit board 176 when positioned in the card edge connector 112 when there is no risk of stubbing such contacts. As such, the contacts of the card edge connector 112 may be made electrically shorter, eliminating electrical stub at the ends of the contacts of the card edge connector 112 enhancing electrical performance through the communication system 100.

In an exemplary embodiment, the pluggable body 170 provides heat transfer for the module circuit board 176, such as for the electronic components on the module circuit board 176. For example, the module circuit board 176 is in thermal communication with the pluggable body 170 and the pluggable body 170 transfers heat from the module circuit board 176. Optionally, the pluggable body 170 may include a plurality of heat transfer fins 194 along at least a portion of the outer perimeter, such as the top 180, of the pluggable module 106 for dissipating heat from the pluggable body 170.

Figure 4:
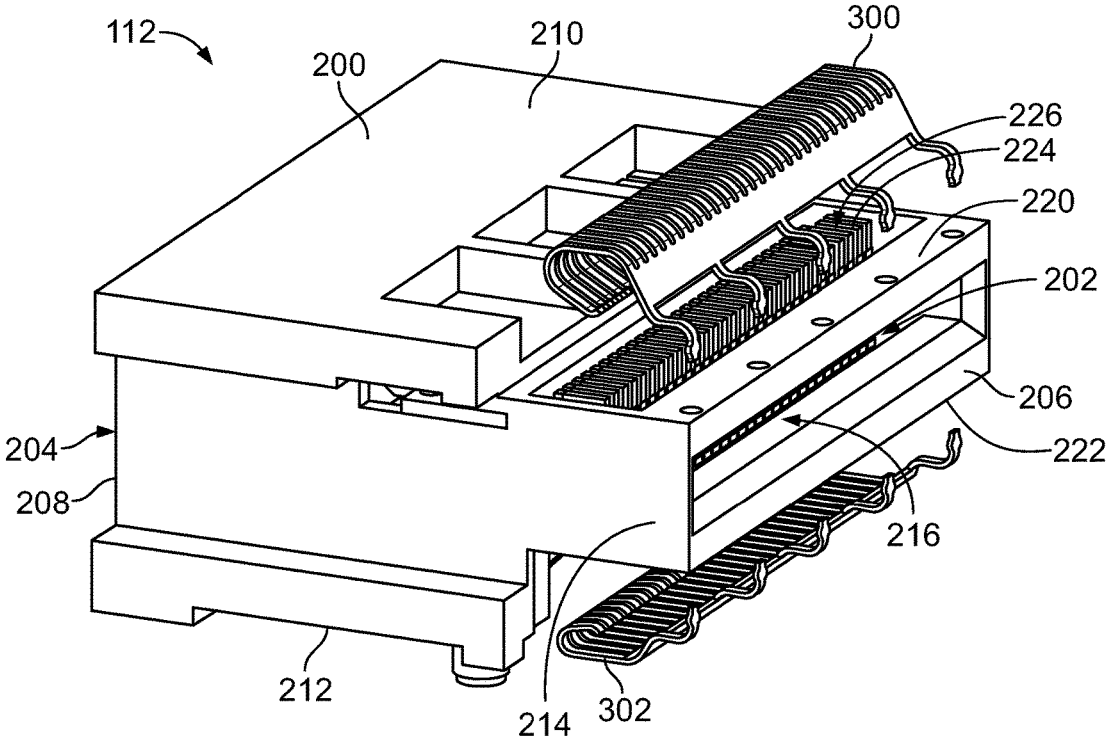
FIG. 4 is an exploded view of a card edge connector of the communication system in accordance with an exemplary embodiment.

FIG. 4 is an exploded view of the card edge connector 112 in accordance with an exemplary embodiment. The card edge connector 112 includes a housing 200 having a contact assembly 202 received in a cavity 204 of the housing 200. The housing 200 extends between a front 206 and a rear 208. The housing 200 extends between a top 210 and a bottom 212. In the illustrated embodiment, the bottom 212 defines a mounting end configured to be mounted to the host circuit board 102 and the front 206 defines the mating end configured to be mated with the pluggable module 106.

The housing 200 includes a shroud 214 at the front 206 configured to be mated with the pluggable module 106. The shroud 214 includes a front face 218, a top wall 220 and bottom wall 222. The top wall 220 and the bottom wall 222 join the front face 218 to the top 210 and the bottom 212, respectively. In an exemplary embodiment, the shroud 214 is configured to be received in the pluggable module 106. For example, the shroud 214 may be received between the module top wall 190 (shown in FIG. 3) and the module bottom wall 192 (shown in FIG. 3). The front face 218 of the shroud 214 includes a card slot 216 that receives the card edge 178 (shown in FIG. 3) of the module circuit board 176 (shown in FIG. 3). In the illustrated embodiment, the top wall 220 includes a plurality of support fingers 224 separated by gaps 226. The support fingers 224 support individual contacts of the contact assembly 202 and the support fingers 224 are individually movable relative to each other to move the contacts relative to each other, such as during mating with the pluggable module 106. The bottom wall 222 may include similar support fingers separated by gaps.

In an exemplary embodiment, the card edge connector 112 includes upper biasing members 300 at the top wall 220 and the lower biasing members 302 at the bottom wall 222. The upper biasing members 300 are configured to engage corresponding support fingers 224 and actuate corresponding support fingers 224 when engaged by the pluggable module 106. The upper biasing members 300 are configured to be actuated by the module top wall 190 when the pluggable module 106 is mated with the card edge connector 112. The lower biasing members 302 are configured to be actuated by the module bottom wall 192 when the pluggable module 106 is mated with the card edge connector 112. The upper biasing members 300 are used to actuate contacts of the contact assembly 202 to mate with the module circuit board 176 when the pluggable module 106 is mated with the card edge connector 112. The lower biasing members 302 are used to actuate contacts of the contact assembly 202 to mate with the module circuit board 176 when the pluggable module 106 is mated with the card edge connector 112. As such, the mating action of the pluggable module 106 with the card edge connector 112 is used to activate the mating action and electrical connection between the card edge connector 112 and the module circuit board 176.

Figure 5:
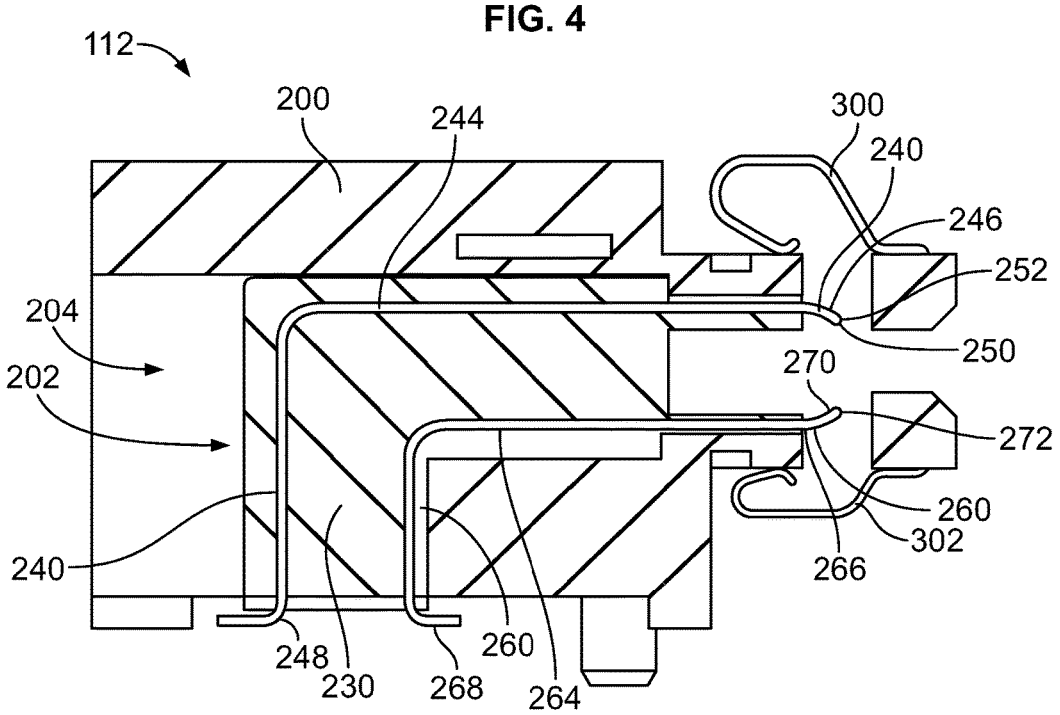
FIG. 5 is a cross-sectional view of the card edge connector in accordance with an exemplary embodiment.

FIG. 5 is a cross-sectional view of the card edge connector 112 in accordance with an exemplary embodiment. The contact assembly 202 includes upper contacts 240 arranged in an upper contact array 242 and lower contacts 260 arranged in a lower contact array 262. In an exemplary embodiment, the upper and lower contacts 240, 260 are held in at least one contact holder 230. For example, the contact holder 230 may be a dielectric body holding one or more upper contact 240 and/or one or more lower contact 260. The contact holder 230 is separate from the housing 200 and loaded into the housing 200, such as through the rear 208 or the bottom 212. Alternatively, the contacts may be loaded directly into the housing 200 rather than into a separate contact holder 230.

In various embodiments, the contact holder 230 may be overmolded over one or more upper contact 240 and/or one or more lower contact 260. In various embodiments, the upper contacts 240 of the upper contact array 242 may be overmolded by an upper contact holder and the lower contacts 260 of the lower contact array 262 may be overmolded by a lower contact holder separate and discrete from the upper contact holder that are separately loaded into the cavity 204 of the housing 200. In other various embodiments, the upper contacts 240 may be paired with corresponding lower contacts 260 in corresponding wafers and overmolded by a corresponding wafer body defining the corresponding contact holder 230. The dielectric wafers may be stacked together in a wafer stack and loaded into the cavity 204, such as through the rear 208 or the bottom 212 of the housing 200.

Each upper contact 240 includes a transition portion 244 extending between a mating end 246 and a terminating end 248. The transition portion 244 is held by the contact holder 230. The terminating end 248 is configured to be terminated to the host circuit board 102. The mating end 246 is configured to extend into the shroud 214 for mating with the module circuit board 176. In an exemplary embodiment, the mating end 246 includes a mating interface 250 at a distal end 252 of the upper contact 240. The mating interface 250 is defined by a curved bump at the distal end 252. The upper contact 240 is cut off beyond the mating interface 250 such that the upper contact 240 does not electrically stub beyond the mating interface 250. In an exemplary embodiment, the upper contacts 240 are flexible and configured to be elastically deformed and flexed during use, such as during mating with the module circuit board 176.

Each lower contact 260 includes a transition portion 264 extending between a mating end 266 and a terminating end 268. The transition portion 264 is held by the contact holder 230. The terminating end 268 is configured to be terminated to the host circuit board 102. The mating end 266 is configured to extend into the shroud 214 for mating with the module circuit board 176. In an exemplary embodiment, the mating end 266 includes a mating interface 270 at a distal end 272 of the lower contact 260. The mating interface 270 is defined by a curved bump at the distal end 272. The lower contact 260 is cut off beyond the mating interface 270 such that the lower contact 260 does not electrically stub beyond the mating interface 270. In an exemplary embodiment, the lower contacts 260 are flexible and configured to be elastically deformed and flexed during use, such as during mating with the module circuit board 176.

Figure 6:
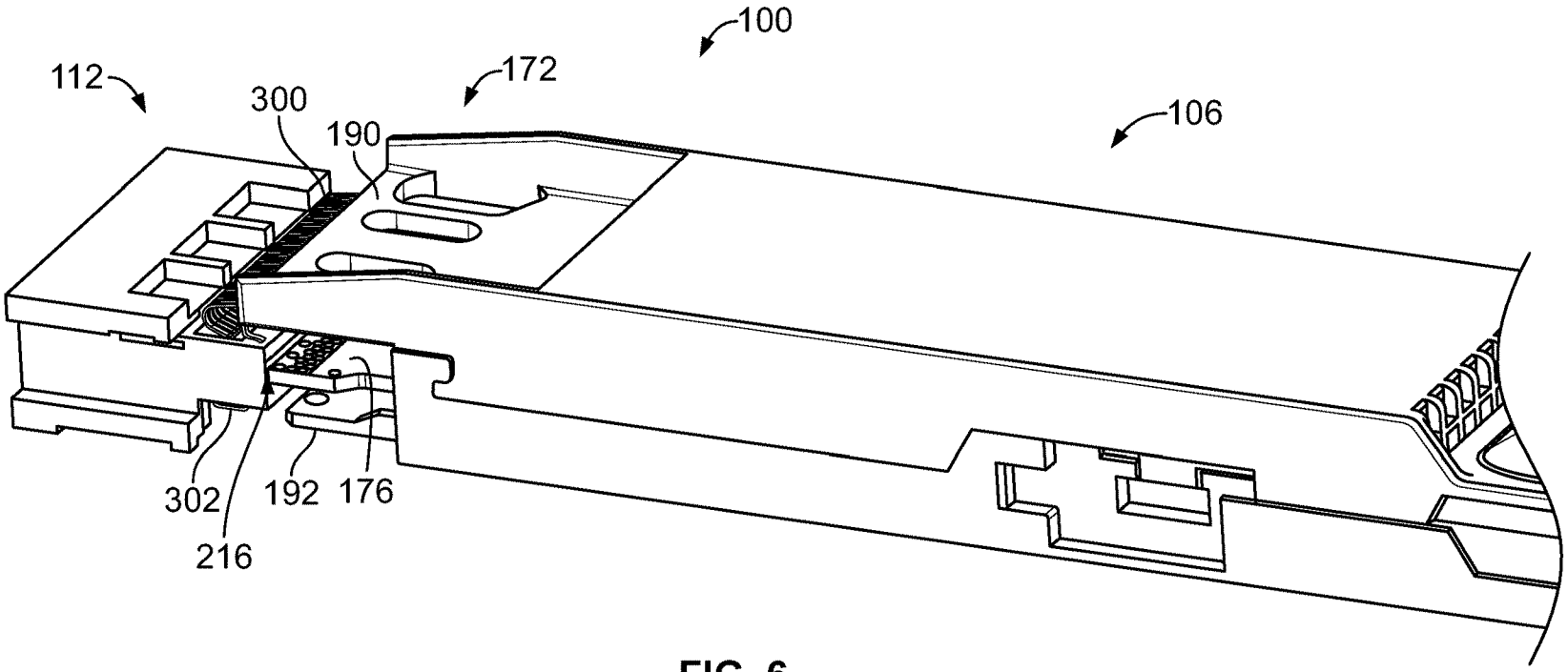
FIG. 6 is a perspective view of a portion of the communication system showing the pluggable module poised for mating with the card edge connector in accordance with an exemplary embodiment.

FIG. 6 is a perspective view of a portion of the communication system 100 showing the pluggable module 106 poised for mating with the card edge connector 112. The receptacle cage 110 (shown in FIG. 1) is removed to illustrate the card edge connector 112 and the pluggable module 106. The mating end 172 of the pluggable module 106 faces the card edge connector 112 and is configured to be loaded into the card slot 216. The module circuit board 176 of the pluggable module 106 is configured to be plugged into the card edge connector 112. The module top wall 190 and the module bottom wall 192 are configured to engage the card edge connector 112 during mating.

Figure 7:
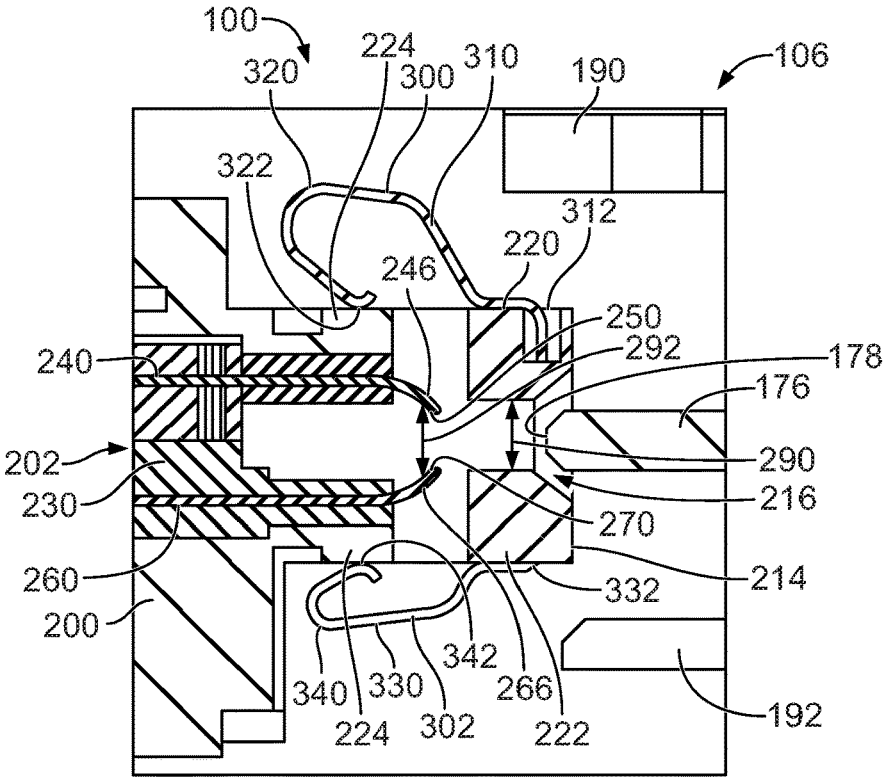
FIG. 7 is a cross-sectional view of a portion of the communication system showing the pluggable module poised for mating with the card edge connector.
Figure 8:
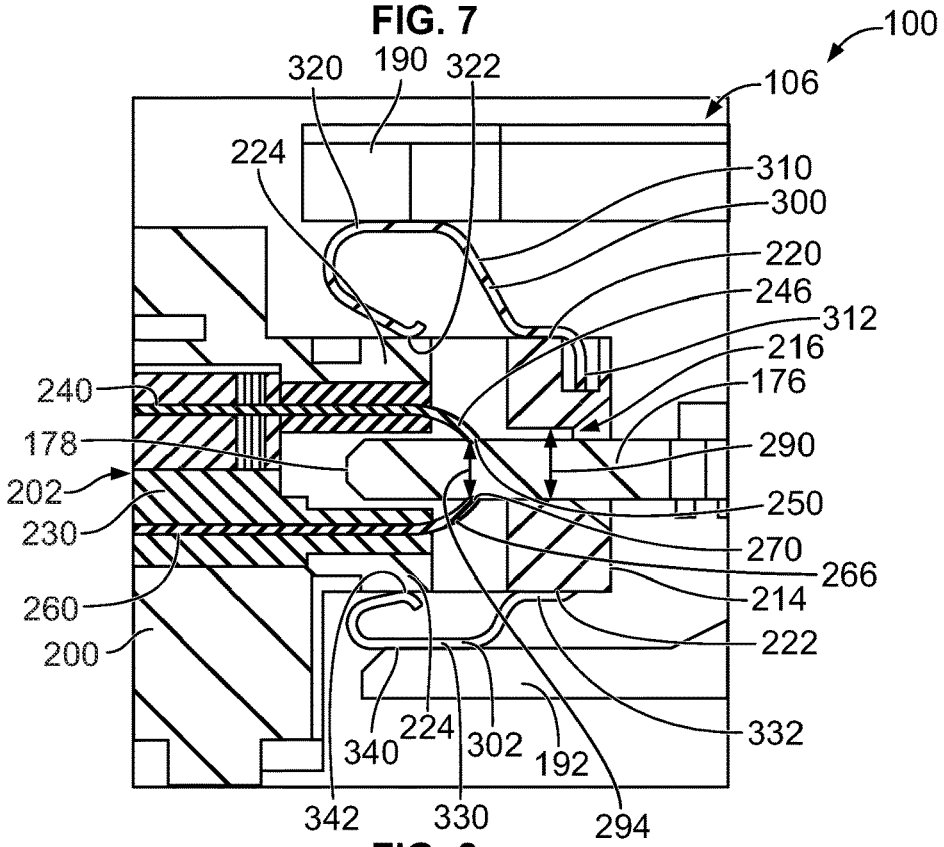
FIG. 8 is a cross-sectional view of a portion of the communication system showing the pluggable module mated with the card edge connector.

FIG. 7 is a cross-sectional view of a portion of the communication system 100 showing the pluggable module 106 poised for mating with the card edge connector 112. FIG. 8 is a cross-sectional view of a portion of the communication system 100 showing the pluggable module 106 mated with the card edge connector 112.

During mating, the shroud 214 is received in the pluggable module 106 between the module top wall 190 and the module bottom wall 192. The card slot 216 cooperatively receives the card edge 178 of the module circuit board 176. The upper biasing members 300 at the top wall 220 interfaces with the module top wall 190 during mating and the lower biasing members 302 interfaces with the module bottom wall 192 during mating to electrically connect the contact assembly 202 with the module circuit board 176.

During mating, the upper and lower contacts 240, 260 are movable between released or unmated positions (FIG. 7) and flexed or mated positions (FIG. 8). For example, the upper and lower contacts 240, 260 may be deflected inward from the unmated positions to the mated positions. The upper and lower biasing members 300, 302 are used to actuate and flex the upper and lower contacts 240, 260 inward. The upper and lower contacts 240, 260 are clamped onto the top and bottom surfaces of the module circuit board 176 once the leading edge of the module circuit board 176 clears the mating ends 246, 266 of the contacts 240, 260. The upper and lower biasing members 300, 302 are activated by the pluggable module 106. For example, the upper and lower biasing members 300, 302 are activated by the module top wall 190 and the module bottom wall 192 when the pluggable module 106 is mated with the card edge connector 112.

In the unmated positions, the module circuit board 176 is free to move in and out of the card slot 216 without interference with the mating ends 246, 266. In other words, the mating ends 246, 266 do not interfere with the loading and unloading of the module circuit board 176. The module circuit board 176 does not stub against the mating ends 246, 266 during loading of the module circuit board 176 into the card slot 216 because the upper and lower contacts 240, 260 are spread apart at wide clearance positions to allow the module circuit board 176 to be loaded into the card slot 216 freely. For example, the card slot 216 has a height 290. In the unmated positions (FIG. 7), the mating ends 246, 266 are separated by a first separation distance 292 that is greater than the height 290, whereas in the mated positions (FIG. 8), the mating ends 246, 266 are separated by a second separation distance 294 that is less than the height 290, which is equal to the thickness of the module circuit board 176 such that the mating ends 246, 266 engage the top and bottom surfaces of the module circuit board 176. In the unmated positions (FIG. 7), there is clearance to allow the module circuit board 176 to pass freely into the card slot 216 without stubbing against either of the mating ends 246, 266. Neither of the contacts 240, 260 require extensions or lead-ins beyond the mating interfaces 250, 270, which would otherwise create electrical stubs beyond the mating interfaces 250, 270. In other words, the mating ends 246, 266 are able to stop or terminate at the mating interfaces 250, 270 without requiring additional extensions or lead-ins as is typical with conventional contacts.

In an exemplary embodiment, the upper biasing member 300 includes a spring beam 310 having a base 312 coupled to the top wall 220, such as near the front of the shroud 214. The spring beam 310 is located exterior of the shroud 214 above the top wall 220. The spring beam 310 is configured to interface with the module top wall 190 and is actuated by the module top wall 190 when the pluggable module 106 is mated with the card edge connector 112. The spring beam 310 is configured to interact with the contact assembly 202 to actuate the upper contact 240 and move the upper contact 240 between the unmated position and the mated position. The spring beam 310 is configured to be spring biased between the module top wall 190 and the contact assembly 202. Optionally, the spring beam 310 may directly engage the contact holder 230. Alternatively, the spring beam 310 may directly engage the top wall 220 of the housing 200 and cause the top wall 220 of the housing 200 to flex, causing the contact holder 230 to correspondingly flex. The flexing of the contact holder 230 causes the mating end 246 of the upper contact 240 to move from the unmated position to the mated position.

The upper biasing member 300 includes an outer biasing surface 320 and an inner biasing surface 322. The outer biasing surface 320 engages the pluggable module 106 when the pluggable module 106 is mated with the card edge connector 112. For example, the outer biasing surface 320 engages the module top wall 190 when the pluggable module 106 is mated with the card edge connector 112. The inner biasing surface 322 operably engages the contact assembly 202 proximate to the upper contact 240. For example, the inner biasing surface 322 may operably engage the contact holder 230, which causes the mating end 246 to flex and move from the unmated position to the mated position. For example, the inner biasing surface 322 may operably engage the contact holder 230 by directly engaging the contact holder 230 or indirectly engaging the contact holder 230. In other various embodiments, the inner biasing surface 322 may engage the housing 200, such as at the support finger 224 of the top wall 220 to flex the support finger 224 against the contact holder 230, which may cause the contact holder 230 to flex and move the mating end 246 between the unmated position and the mated position.

In an exemplary embodiment, the lower biasing member 300 includes a spring beam 330 having a base 332 coupled to the bottom wall 222, such as near the front of the shroud 214. The spring beam 330 is located exterior of the shroud 214 below the bottom wall 222. The spring beam 330 is configured to interface with the module bottom wall 192 and is actuated by the module bottom wall 192 when the pluggable module 106 is mated with the card edge connector 112. The spring beam 330 is configured to interact with the contact assembly 202 to actuate the lower contact 260 and move the lower contact 260 between the unmated position and the mated position. The spring beam 330 is configured to be spring biased between the module bottom wall 192 and the contact assembly 202. Optionally, the spring beam 330 may directly engage the contact holder 230. Alternatively, the spring beam 330 may directly engage the bottom wall 222 of the housing 200 and cause the bottom wall 222 of the housing 200 to flex, causing the contact holder 230 to correspondingly flex. The flexing of the contact holder 230 causes the mating end 266 of the lower contact 260 to move from the unmated position to the mated position.

The lower biasing member 300 includes an outer biasing surface 340 and an inner biasing surface 342. The outer biasing surface 340 engages the pluggable module 106 when the pluggable module 106 is mated with the card edge connector 112. For example, the outer biasing surface 340 engages the module bottom wall 192 when the pluggable module 106 is mated with the card edge connector 112. The inner biasing surface 342 operably engages the contact assembly 202 proximate to the lower contact 260. For example, the inner biasing surface 342 may operably engage the contact holder 230, which causes the mating end 266 to flex and move from the unmated position to the mated position. For example, the inner biasing surface 342 may operably engage the contact holder 230 by directly engaging the contact holder 230. In other various embodiments, the inner biasing surface 342 may engage the housing 200, such as at a support finger of the bottom wall 222 to flex the support finger at the bottom wall 222 against the contact holder 230, which may cause the contact holder 230 to flex and move the mating end 266 between the unmated position and the mated position.

Figure 9:
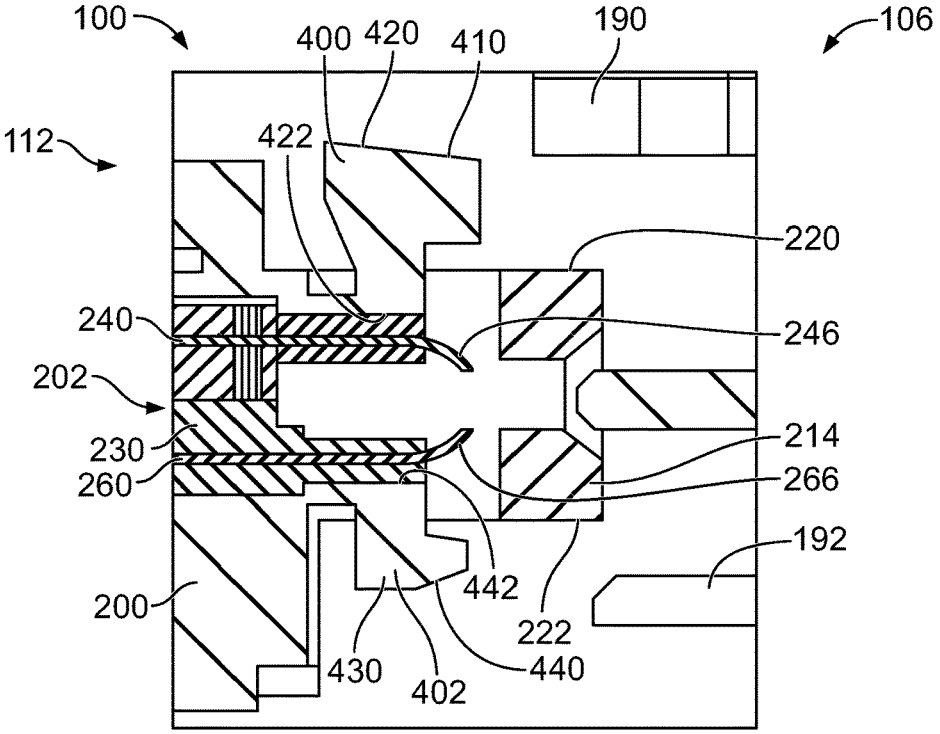
FIG. 9 is a cross-sectional view of a portion of the communication system showing the pluggable module poised for mating with the card edge connector in accordance with an exemplary embodiment.
Figure 10:
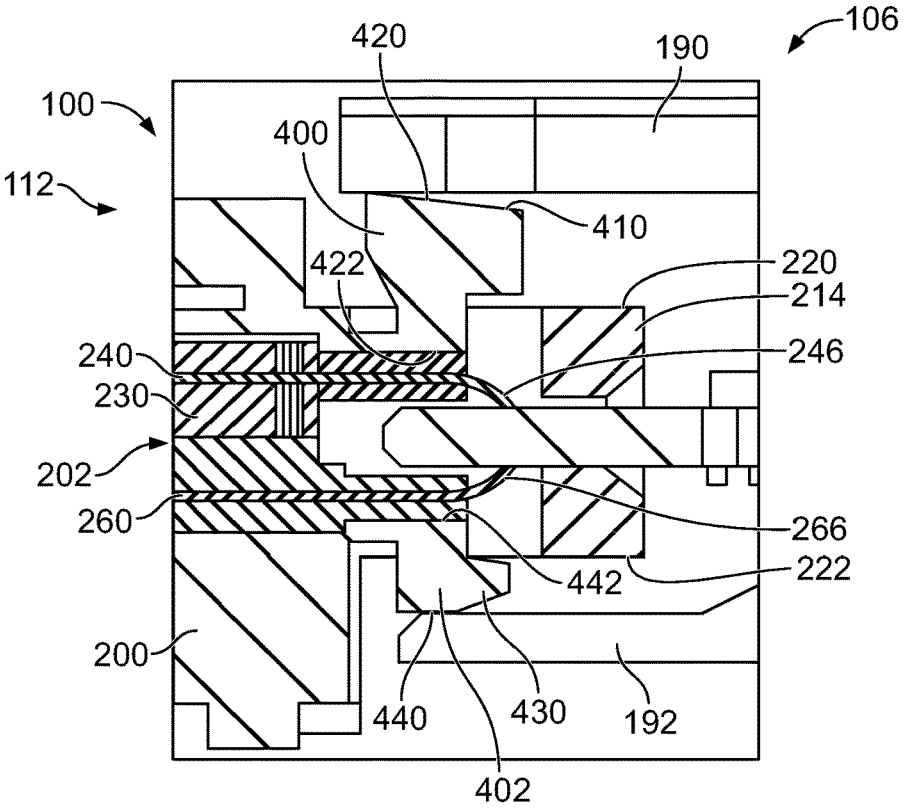
FIG. 10 is a cross-sectional view of a portion of the communication system showing the pluggable module mated with the card edge connector in accordance with an exemplary embodiment.

FIG. 9 is a cross-sectional view of a portion of the communication system 100 showing the pluggable module 106 poised for mating with the card edge connector 112 in accordance with an exemplary embodiment. FIG. 10 is a cross-sectional view of a portion of the communication system 100 showing the pluggable module 106 mated with the card edge connector 112 in accordance with an exemplary embodiment. FIGS. 9 and 10 illustrate the card edge connector 112 having upper and lower biasing members 400, 402 in the form of wedges 410, 430 formed integral with the housing 200 as an alternative to the spring beams 310, 330 (shown in FIGS. 7 and 8). The wedges 410, 430 operate similar to the spring beams 310, 330 to actuate the upper and lower contacts 240, 260 when the pluggable module 106 is mated with the card edge connector 112.

The wedge 410 is located exterior of the shroud 214 above the top wall 220. The wedge 410 is configured to interface with the module top wall 190 and is actuated by the module top wall 190 when the pluggable module 106 is mated with the card edge connector 112. The wedge 410 is configured to interact with the contact assembly 202 to actuate the upper contact 240 and move the upper contact 240 between the unmated position and the mated position. More specifically, as shown in FIGS. 9 and 10, the wedge 410 may directly engage the contact holder 230 causing the mating end 246 of the upper contact 240 to move from the unmated position to the mated position.

The upper biasing member 400 includes an outer biasing surface 420 and an inner biasing surface 422. The outer biasing surface 420 engages the pluggable module 106 when the pluggable module 106 is mated with the card edge connector 112. For example, the outer biasing surface 420 engages the module top wall 190 when the pluggable module 106 is mated with the card edge connector 112. The inner biasing surface 422 engages the contact assembly 202 proximate to the upper contact 240. For example, the inner biasing surface 422 may engage the contact holder 230 to flex the contact holder 230 to move the mating end 246 from the unmated position to the mated position.

The wedge 430 is configured to interface with the module bottom wall 192 and is actuated by the module bottom wall 192 when the pluggable module 106 is mated with the card edge connector 112. The wedge 430 is configured to interact with the contact assembly 202 to actuate the lower contact 260 and move the lower contact 260 between the unmated position and the mated position. More specifically, as shown in FIGS. 9 and 10, the wedge 430 may directly engage the contact holder 230 causing the mating end 266 of the lower contact 260 to move from the unmated position to the mated position.

The lower biasing member 402 includes an outer biasing surface 440 and an inner biasing surface 442. The outer biasing surface 440 engages the pluggable module 106 when the pluggable module 106 is mated with the card edge connector 112. For example, the outer biasing surface 440 engages the module bottom wall 192 when the pluggable module 106 is mated with the card edge connector 112. The inner biasing surface 442 engages the contact assembly 202 proximate to the lower contact 260. For example, the inner biasing surface 442 may engage the contact holder 230 to flex the contact holder 230 to move the mating end 266 from the unmated position to the mated position. In other various embodiments, the inner biasing surface 442 may engage the housing 200, such as at the bottom wall 222 to flex the bottom wall 222 against the contact holder 230, which may cause the contact holder 230 to flex and move the mating end 266 between the unmated position and the mated position.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure.

What is claimed is:

1. A card edge connector for mating with a pluggable module comprising:

a housing extending between a front and a rear, the housing having a cavity between the front and the rear, the housing having a card slot configured to receive a card edge of a module circuit board of the pluggable module, the housing having a top wall above the card slot and a bottom wall below the card slot;

a contact assembly received in the cavity, the contact assembly having contacts having mating ends along the card slot for mating with the module circuit board and terminating ends opposite the mating ends; and biasing members extending from the housing, each biasing member having an outer biasing surface configured to engage the pluggable module when the pluggable module is mated with the card edge connector and each biasing member having an inner biasing surface configured to operably engage the contact assembly proximate to the corresponding contact, wherein the biasing member is movable from a released position to a compressed position as the pluggable module is mated with the card edge connector, the biasing members moving the contacts from unmated positions to mated positions as the biasing members are moved from the released positions to the compressed positions.

2. The card edge connector of claim 1, wherein the mating ends of the contacts are deflectable into the card slot as the contacts are moved from the unmated positions to the mated positions.

3. The card edge connector of claim 1, wherein the mating ends of the contacts are moved to the mated positions by the engagement of the biasing members with the pluggable module as the outer biasing surfaces engage the pluggable module after the module circuit board clears the mating ends of the contacts.

4. The card edge connector of claim 1, wherein the mating ends include mating interfaces at distal ends of the contacts.

5. The card edge connector of claim 1, wherein the contact assembly includes a contact holder holding the contacts, the inner biasing surfaces engaging the contact holder and flexing the contact holder inward to move the mating ends of the contacts from the unmated positions to the mated positions.

6. The card edge connector of claim 1, wherein the contact assembly includes a plurality of contact holders, each contact holder holding a corresponding contact, the inner biasing surfaces engaging the corresponding contact holders and flexing the contact holders inward to move the mating ends of the contacts from the unmated positions to the mated positions.

7. The card edge connector of claim 1, wherein the card slot has a height, the contacts are arranged in an upper array of upper contacts and a lower array of lower contacts, the mating ends of the upper contacts having a first separation distance from the mating ends of the lower contacts in the unmated position greater than the height, the mating ends of the upper contacts having a second separation distance from the mating ends of the lower contacts in the mated position less than the height.

8. The card edge connector of claim 1, wherein the biasing members comprise spring beams being compressible against the contact assembly to flex the contacts from the unmated positions to the mated positions.

9. The card edge connector of claim 1, wherein the biasing members comprise spring beams being compressible against the top wall of the housing to flex the contacts from the unmated positions to the mated positions.

10. The card edge connector of claim 1, wherein the biasing members comprise wedges above the contact assembly configured to engage the pluggable module when the pluggable module is mated with the card edge connector.

11. The card edge connector of claim 1, the biasing members are upper biasing members extending from the top wall, the card edge connector further comprising lower biasing members at the bottom wall, each lower biasing member having an outer biasing surface configured to engage the pluggable module when the pluggable module is mated with the card edge connector and each lower biasing member having an inner biasing surface configured to operably engage the contact assembly, wherein the lower biasing member is movable from a released position to a compressed position as the pluggable module is mated with the card edge connector, the lower biasing member moving the corresponding contact from an unmated position to a mated position as the lower biasing member is moved from the released position to the compressed position.

12. A card edge connector for mating with a pluggable module comprising:

a housing extending between a front and a rear, the housing having a cavity between the front and the rear, the housing having a card slot configured to receive a card edge of a module circuit board of the pluggable module, the housing having a top wall above the card slot and a bottom wall below the card slot;

a contact assembly received in the cavity, the contact assembly having upper contacts arranged in an upper contact array and lower contacts arranged in a lower contact array, the upper contacts having mating ends extending along the card slot for mating with the module circuit board and terminating ends opposite the mating ends, the lower contacts having mating ends extending along the card slot for mating with the circuit board and terminating ends opposite the mating ends;

upper biasing members at the top wall associated with corresponding upper contacts, each upper biasing member having an outer biasing surface configured to engage the pluggable module when the pluggable module is mated with the card edge connector and each upper biasing member having an inner biasing surface configured to operably engage the contact assembly proximate to the corresponding upper contact, wherein the upper biasing member is movable from a released position to a compressed position as the pluggable module is mated with the card edge connector, the upper biasing member moving the upper contact from an unmated position to a mated position as the upper biasing member is moved from the released position to the compressed position; and lower biasing members at the bottom wall associated with corresponding lower contacts, each lower biasing member having an outer biasing surface configured to engage the pluggable module when the pluggable module is mated with the card edge connector and each lower biasing member having an inner biasing surface configured to operably engage the contact assembly proximate to the corresponding lower contact, wherein the lower biasing member is movable from a released position to a compressed position as the pluggable module is mated with the card edge connector, the lower biasing member moving the lower contact from an unmated position to a mated position as the lower biasing member is moved from the released position to the compressed position.

13. The card edge connector of claim 12, wherein the mating ends of the upper contacts are deflectable toward the mating ends of the lower contacts and the mating ends of the lower contacts are deflectable toward the mating ends of the upper contacts as the upper contacts and the lower contacts are moved from the unmated positions to the mated positions.

14. The card edge connector of claim 12, wherein the mating ends of the upper contacts are moved to the mated positions by the engagement of the upper biasing members with the pluggable module and the mating ends of the lower contacts are moved to the mated positions by the engagement of the lower biasing members with the pluggable module as the outer biasing surfaces engage the pluggable module after the module circuit board clears the mating ends of the upper contacts and the lower contacts.

15. The card edge connector of claim 12, wherein the mating ends include mating interfaces at distal ends of the upper contacts and the lower contacts.

16. The card edge connector of claim 12, wherein the contact assembly includes at least one contact holder holding the upper contacts and the lower contacts, the inner biasing surfaces engaging the at least one contact holder and flexing the at least one contact holder inward to move the mating ends from the unmated positions to the mated positions.

17. The card edge connector of claim 12, wherein the card slot has a height, the mating ends of the upper and lower contacts having a first separation distance in the unmated position greater than the height, the mating ends of the upper and lower contacts having a second separation distance in the mated position less than the height.

18. A communication system comprising:

a pluggable module having a pluggable body having a mating end and a module circuit board at the mating end, the module circuit board having a card edge, the pluggable body having a module upper wall at the mating end above the card edge and a module lower wall at the mating end below the card edge; and a card edge connector receiving the pluggable module, the card edge connector comprising:

a housing extending between a front and a rear, the housing having a cavity between the front and the rear, the housing having a card slot at the front receiving the card edge of the module circuit board, the housing having a top wall above the card slot and a bottom wall below the card slot;

a contact assembly received in the cavity, the contact assembly having upper contacts arranged in an upper contact array and lower contacts arranged in a lower contact array, the upper contacts having mating ends along the card slot for mating with the module circuit board and terminating ends opposite the mating ends, the lower contacts having mating ends along the card slot for mating with the circuit board and terminating ends opposite the mating ends;

upper biasing members at the top wall associated with corresponding upper contacts, each upper biasing member having an outer biasing surface engaging the module upper wall when the pluggable module is mated with the card edge connector and each upper biasing member having an inner biasing surface engaging the contact assembly proximate to the corresponding upper contact, wherein the upper biasing member is movable from a released position to a compressed position as the pluggable module is mated with the card edge connector, the upper biasing member moving the upper contact from an unmated position to a mated position as the upper biasing member is moved from the released position to the compressed position; and lower biasing members at the bottom wall associated with corresponding lower contacts, each lower biasing member having an outer biasing surface engaging the module lower wall when the pluggable module is mated with the card edge connector and each lower biasing member having an inner biasing surface engaging the contact assembly proximate to the corresponding lower contact, wherein the lower biasing member is movable from a released position to a compressed position as the pluggable module is mated with the card edge connector, the lower biasing member moving the lower contact from an unmated position to a mated position as the lower biasing member is moved from the released position to the compressed position.

19. The communication system of claim 18, wherein the mating ends of the upper contacts are deflectable toward the mating ends of the lower contacts and the mating ends of the lower contacts are deflectable toward the mating ends of the upper contacts as the upper contacts and the lower contacts are moved from the unmated positions to the mated positions.

20. The communication system of claim 18, wherein the mating ends of the upper contacts are moved to the mated positions by the engagement of the upper biasing members with the pluggable module and the mating ends of the lower contacts are moved to the mated positions by the engagement of the lower biasing members with the pluggable module as the outer biasing surfaces engage the pluggable module after the module circuit board clears the mating ends of the upper contacts and the lower contacts.

* * * * *